US005546816A

United States Patent [19]

Jansson et al.

[11] Patent Number: 5,546,816

[45] Date of Patent: Aug. 20, 1996

[54] LOCKABLE SPRING TIGHTENING DEVICE

[75] Inventors: Conny Jansson, Enköping; Håkan Bergqvist; Hans Himbert, both of Bromma, all of Sweden

[73] Assignee: Sandvick AB, Sandviken, Sweden

[21] Appl. No.: 232,011

[22] PCT Filed: Aug. 19, 1993

[86] PCT No.: PCT/SE93/00692

§ 371 Date: Jul. 13, 1994

§ 102(e) Date: Jul. 13, 1994

[87] PCT Pub. No.: WO94/05463

PCT Pub. Date: Mar. 17, 1994

[30] Foreign Application Priority Data

Aug. 31, 1992 [SE] Sweden ..... 9202491-8

[51] Int. Cl.[6] ..... B25B 23/142

[52] U.S. Cl. ..... 73/862.21; 73/847; 81/478

[58] Field of Search ..... 73/847, 862.8, 73/862.23, 862.191, 862.21, 862.22, 862.24; 81/478, 483

[56] References Cited

U.S. PATENT DOCUMENTS

| | | | |
|---|---|---|---|
| 2,607,219 | 8/1952 | Millard et al. | 73/862.21 |
| 2,732,747 | 1/1956 | Livermont | 81/483 |
| 2,887,921 | 5/1959 | Livermont | 73/862.23 |
| 3,140,623 | 7/1964 | Van Hoose | 81/483 |
| 3,165,014 | 1/1965 | Grabovac | 81/483 |
| 3,270,594 | 9/1966 | Grabovac | 81/483 |
| 3,276,296 | 10/1966 | Woods | 81/467 |
| 3,577,815 | 5/1971 | Bergquist | 81/483 |
| 3,666,021 | 5/1972 | Whitehouse | 73/862.23 |
| 3,772,942 | 11/1973 | Grabovac | 81/483 |
| 3,893,354 | 7/1975 | Knoll | 81/483 |
| 4,248,107 | 2/1981 | Blattner | 81/483 |
| 4,467,678 | 8/1984 | Lindholm | 81/483 |
| 4,485,703 | 12/1984 | Grabovac et al. | 81/483 |
| 4,655,104 | 4/1987 | Blattner | 81/483 |
| 4,709,602 | 12/1987 | Grabovac et al. | 81/483 |
| 4,870,879 | 10/1989 | Shieh | 81/483 |
| 5,048,381 | 9/1991 | Allen et al. | 73/862.21 |
| 5,123,289 | 6/1992 | Potesta | 73/862.23 |
| 5,129,293 | 7/1992 | Larson et al. | 81/478 |
| 5,239,875 | 8/1993 | Stasiek et al. | 73/862.23 |
| 5,435,190 | 7/1995 | Jansson et al. | 81/483 |

FOREIGN PATENT DOCUMENTS

| | | | |
|---|---|---|---|
| 2309618 | 9/1974 | Germany | 73/862.23 |

*Primary Examiner*—Richard Chilcot
*Assistant Examiner*—Eric S. McCall
*Attorney, Agent, or Firm*—Burns, Doane, Swecker & Mathis LLP

[57] ABSTRACT

A tool for the controlled tightening of bolts or other threaded objects comprises an arrangement that indicates when the turning moment attains a certain indication moment that is preset by displacing one of the ends of a spring (21), said end being displaced by rotating a screw (13) connected to the grip of the tool. The indication moment can be read off on a scale (31) on the tool's shaft (24), relative to a movable index (33) situated on a sleeve (30) which is actuated in relation to the grip by a thread (12) with a larger pitch than that of thread of the screw (13). The rotation of the grip (11) can be locked relative to the shaft (24) by a detachable handle (10).

13 Claims, 2 Drawing Sheets

LOCKABLE SPRING TIGHTENING DEVICE

BACKGROUND OF THE INVENTION

Tools for the controlled tightening of bolts and other threaded objects are often provided with an indication of when the turning moment has reached a predetermined value and include a spring whose force can be adjusted to a value corresponding to the intended indication moment, for instance by displacement of one of the ends of the spring when rotating the grip of the tool. Thereafter, the tool can be used to tighten several bolts with the same turning moment.

For applications with particularly rigid safety regulations, for instance in aircraft industry, chemical or nuclear industry, there is a necessity to be able to adjust the spring force and the indication moment with a higher precision than what is normally possible with usual tools and to lock the tightening device of the spring so that the preset moment cannot change during work. The present invention relates to a tightening device for this purpose.

BRIEF DESCRIPTION OF THE DRAWINGS

An embodiment of the tightening according to the present invention will now be described with reference to FIGS. 1 to 3.

DETAILED DESCRIPTION OF THE PREFERRED EMBODIMENTS

Figure 1:
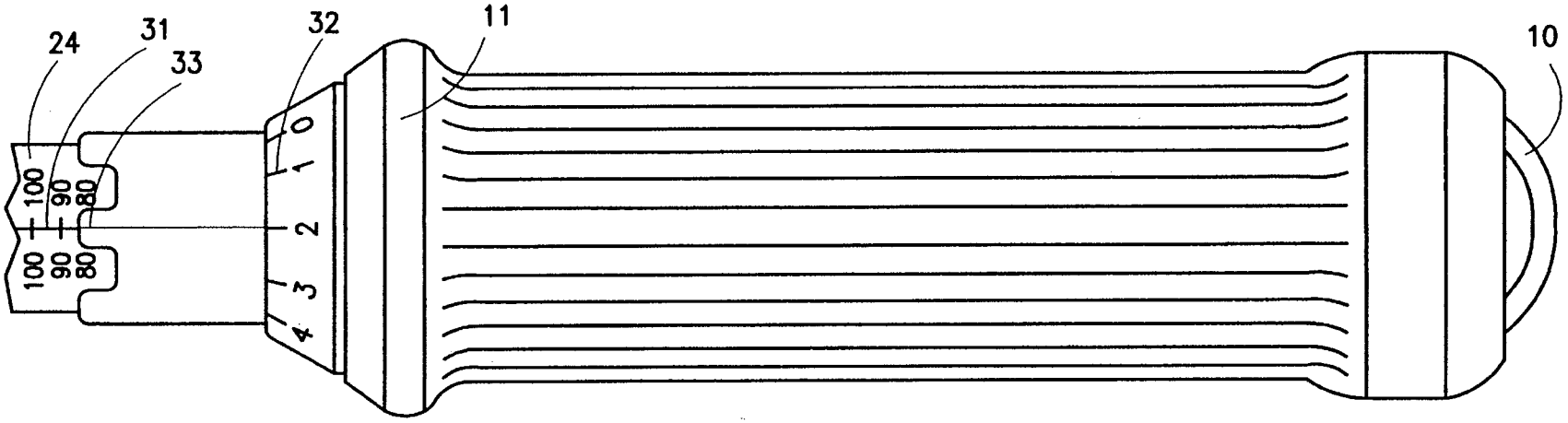
FIG. 1 is an exterior view of a grip with a tightening device and the scales which are used when adjusting the indication moment.
Figure 2:
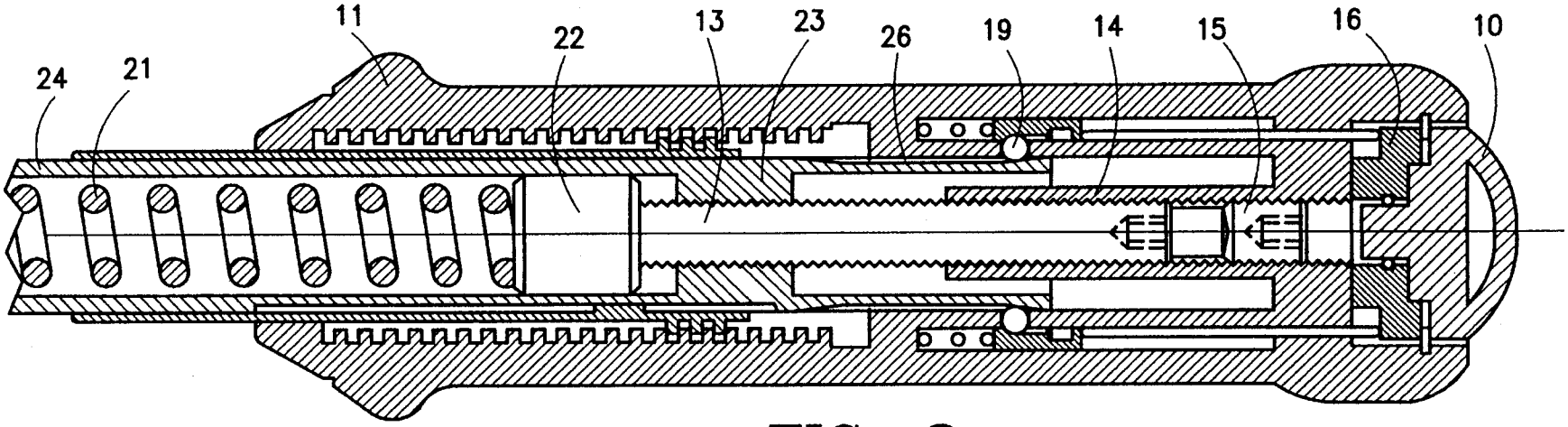
FIG. 2 is a cross-section taken through the grip and the tightening device.
Figure 3:
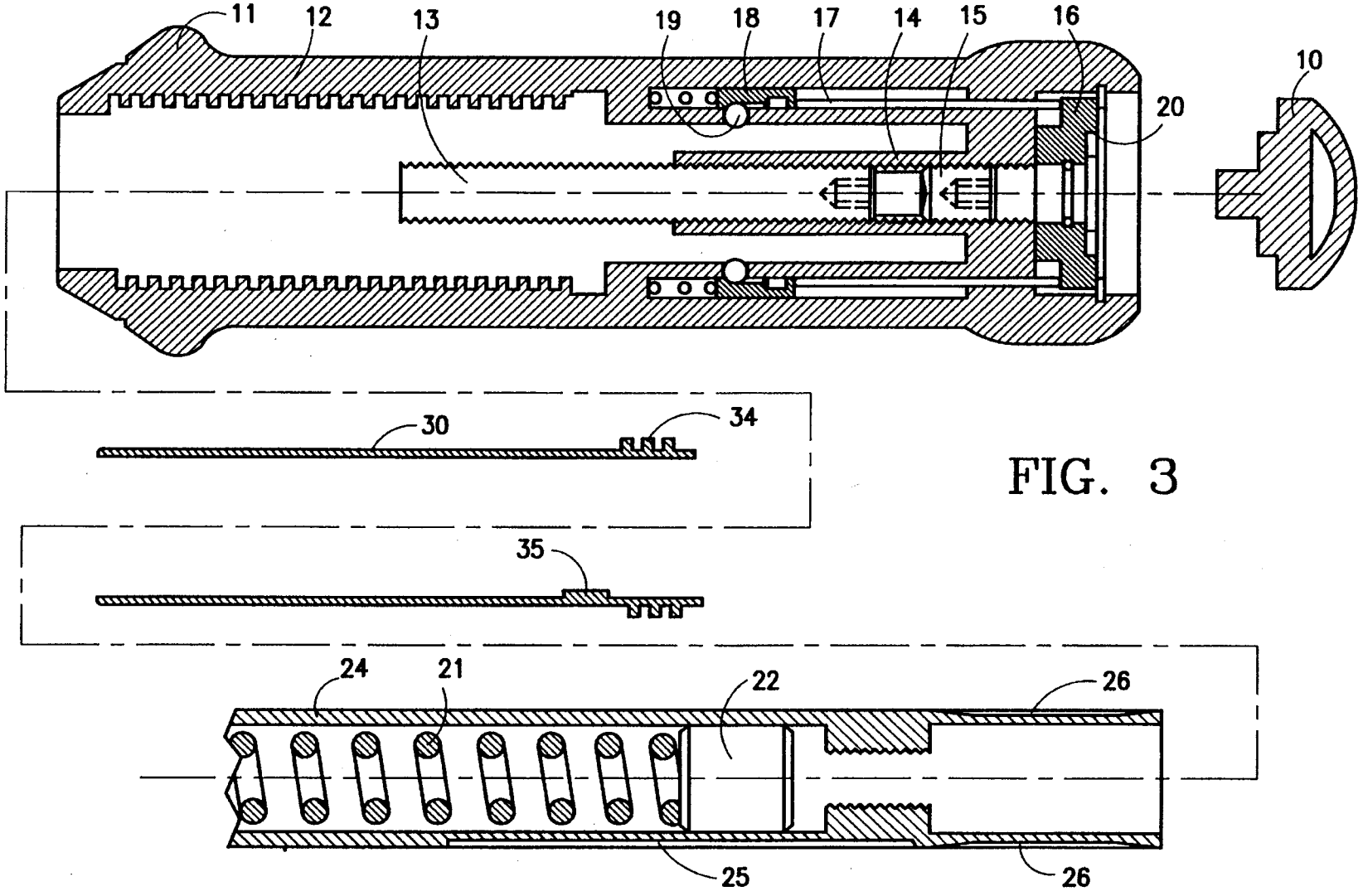
FIG. 3 is an exploded view of the four unities separately.

The lower part of the tool is not shown in the figures and comprises an indication arrangement of known type, for instance as described in U.S. Pat. No. 5,123,289 the subject matter of which is incorporated herein by reference. According to this patent, an indication arrangement gives an optical, acoustic, tactile or electrical indication when the turning moment reaches a certain predetermined indication moment. Further, at its fore end said lower part of said tool comprises a moment transferring part of known type, for instance an axle for coupling different sleeves which can hold different bolts and other threaded objects.

The spring 21 is situated in the shaft 24 of the tool. The force in the spring 21 actuates the indication arrangement not shown in the figures, and thus it determines the indication moment. The force in the spring 21 can be varied by rotation of a grip 11 which also serves the purpose of taking up the forces from the hand when using the tool. The dimensions of the spring 21 have been chosen so that the total rotation angle of the grip 11 becomes a measure of the indication moment. In order to attain sufficient precision at the adjustment, the total rotation angle has to amount to several revolutions, wherefore the reading of the rotation angle is made on two scales, a total scale 31 on the shaft 24 of the tool, and a fine scale 32 around the grip 11. In order to achieve the best precision and a safe reading of the total scale 31, it is read off relative to a movable index 33 whose displacement along the shaft 24 at rotation of the grip 11 is considerably larger than the compression of the spring 21.

In order to avoid any undesired changes of the predetermined indication moment, the rotation of the grip 11 in relation to the shaft 24 can be locked with a detachable handle 10 at the rear of the grip 11.

The compression of the spring 21 which is intended to create the predetermined force, is brought about by a screw 13 connected to the grip 11, which screw is threaded into a threaded bushing 23 connected to the shaft 24. The front end of this screw presses against a slidable abutment piece 22 within the shaft 24. The spring 21 rests against said abutment piece 22. The thread of the screw 13 and the bushing 23 has a small pitch, so that for every revolution of the grip 11 the displacement of the abutment piece 22 and the force increase in the spring become small. This makes it possible to adjust the force with high precision. The rear end of the screw 13 is connected with the grip 11 by a threaded tube 14. The longitudinal position of the screw 13 can be adjusted by turning it in relation to the tube 14, and then it can be fixed by a locking screw 15 which is treaded into the same tube 14.

The reading of the rotation angle of the grip 11 is made by a combination of the total scale 31 on the shaft 24, which scale is read off relative to an index 33 on the fore edge of a sleeve 30 being concentrically placed between the grip 11 and the shaft 24. The sleeve 30 is prevented from rotating by a wedge 35 which can move in a key groove 25 in the shaft 24, and can be displaced in the direction of the shaft by a threaded collar 34 that cooperates with a corresponding thread 12 on the inside of the grip 11. The thread of the collar 34 has a considerably larger pitch than the pitch of the thread of the screw 13, preferrably at least twice as large, and has the opposite threading direction. The rotation of the grip 11 by one revolution then displaces the grip a distance corresponding to the pitch of the screw 13 and the sleeve 30 a distance corresponding to the sum of the pitches of the screw 13 and the collar 34, whereby the scale notches in the total scale 31 can be placed well apart and each scale notch can be provided with a clear numeral.

When the spring force is adjusted to a value corresponding to the predetermined indication moment, one can impede an alteration of this force by locking the rotation of grip 11 in relation to the shaft 24. By the fact that the grip 11 can have different positions along the shaft 24, the locking is effected relative to longitudinally extending slots 26 at the rear of the shaft 24, preferrably equal in number to the notches in the fine scale 32, or to a multiple of that number. Locking elements 19 are provided in orifices on the inner wall of the grip 11, preferrably at least two and in the form of spheres which are radially movable inwardly towards the shaft 24, where they can be brought into engagement with the grooves 26. The locking elements 19 are pressed inwardly and are locked after engaging with the grooves 26 of a spring-loaded locking sleeve 18, whose inner surface comprises conical and cylindrical part surfaces. The pressure upon the locking elements 19 can be eliminated by pressing the locking sleeve 18 by one or several pins 17, whose rear ends are influenced by a ramp on a cam 16 which is rotatable relative to the grip 11. When the pins 17 are pressed frontwards by the cam means 16, then the locking elements 19 come in register with a deeper turned recess in the locking sleeve and are freely movable, so that the grip 11 can rotate for altering the predetermined force. When the ramp of cam means 16 allow the pins 17 to move backwards, then the locking sleeve 18 is pressed backwards by its spring so that the locking elements 19 become locked relative to the grooves 26, if they in angular direction are in register with the grooves 26. The alternation between these two positions is effected by rotating the cam means 16 by a handle or knob 10. The handle is preferrably detachable from the cam means 16 in order to prevent unwarranted altering of the indication moment of the tool. The rotation of the handle 10 is transferred to the cam means 16 by a non-rotation-symmetrical surface 20, for instance one with a polygonal cross-surface.

In order to simplify the manufacture and the assembly, or to enable the choice of an advantageous material in view of comfort and ergonomy, some of the parts of the locking device, for instance the grip 11 and the sleeve 30, can be made of several, mechanically connected parts, within the frame of the invention. Also within the frame of the present invention, the described arrangement of locking elements 19 and locking sleeve 18 can be replaced by other known locking arrangements which can be actuated by the handle 10. Tools comprising a locking device according to the invention can also be used for other purposes than the tightening of threaded objects, for instance for the control of turning moments in springs and axles.

Although only preferred embodiments are specifically illustrated and described herein, it will be appreciated that many modifications and variations of the present invention are possible in light of the above teachings and within the purview of the appended claims without departing from the intended scope of the invention.

We claim:

1. A tightening device for a spring in a moment indicating tool comprising:

a shaft, a spring situated in the shaft, the spring having an end, an indication device actuated by a force of the spring that indicates when a turning moment on the tool attains a predetermined indication moment, a screw for tightening the spring by displacing the end of the spring, a rotatable grip connected with the screw and at least one scale for reading off the indication moment, wherein the total indication moment is read on a longitudinal scale in a direction of the shaft relative to a moveable index which is moveable with respect to the rotatable grip and whose displacement relative to the shaft is larger than a displacement of the end of the spring relative to the shaft.

2. Tightening device according to claim 1, wherein the longitudinal scale is placed on the shaft and the movable index is actuated in relation to the grip by a thread in the grip, which thread is of an opposite direction in comparison to a thread of the screw and has a larger pitch.

3. Tightening device according to claim 2, wherein the movable index is positioned in a front end of a sleeve that is concentrical with the grip and that cooperates with the thread of the grip with a threaded portion.

4. Tightening device according to claim 3, wherein the grip can be prevented from rotating in relation to the shaft by a locking mechanism situated in the grip, which locking mechanism can be actuated by a detachable handle.

5. The tightening device of claim 1, wherein the moveable index comprises a sleeve which is actuated in relation to the grip by a thread in the grip, which thread has a larger pitch than a thread of the screw.

6. The tightening device of claim 5, wherein the thread in the grip is opposite in direction to the thread of the screw.

7. The tightening device of claim 5, wherein the thread in the grip has a pitch which is at least twice as large as the pitch of the thread of the screw.

8. A moment indicating apparatus comprising:

a shaft;

a spring disposed within the shaft, the spring having an end;

a screw for tightening the spring by displacing the end of the spring;

a rotatable handle connected with the screw;

a longitudinal scale disposed on the shaft for reading an indication moment; and a moveable index, which is moveable with respect to the rotatable handle, for indicating the indication moment on the longitudinal scale, wherein the moveable index has a longitudinal displacement relative to the longitudinal scale which is larger than a longitudinal displacement of the end of the spring relative to the shaft.

9. The moment indicating apparatus of claim 8, wherein the movable index comprises a sleeve which is actuated in relation to the rotatable handle by a thread in the rotatable handle, which thread has a larger pitch than, and is opposite in direction to, the thread of the screw.

10. The moment indicating apparatus of claim 9, wherein the thread in the rotatable handle has a pitch which is at least twice as large as the pitch of the thread of the screw.

11. The moment indicating apparatus of claim 8, wherein the movable index has a longitudinal displacement relative to the shaft which is greater than a longitudinal displacement of the rotatable handle relative to the shaft.

12. The moment indicating apparatus of claim 1, wherein the movable index has a displacement relative to the shaft which is greater than a displacement of the grip relative to the shaft.

13. A moment indicating apparatus comprising:

a shaft;

a spring disposed within the shaft, the spring having an end;

a screw for tightening the spring by displacing the end of the spring;

a rotatable handle connected with the screw;

a longitudinal scale disposed on the shaft for reading an indication moment; and a moveable index, which is moveable with respect to the rotatable handle, for indicating the indication moment on the longitudinal scale, wherein the moveable index has a longitudinal displacement relative to the shaft which is greater than a longitudinal displacement of the rotatable handle relative to the shaft.

* * * * *